US007714807B2

(12) United States Patent
Lee et al.

(10) Patent No.: US 7,714,807 B2
(45) Date of Patent: May 11, 2010

(54) PLASMA DISPLAY APPARATUS AND METHOD OF DRIVING THE SAME

(75) Inventors: Yang Keun Lee, Gumi-si (KR); Kyung Ryeol Shim, Gumi-si (KR); Myung Soo Ham, Pusan (KR)

(73) Assignee: LG Electronics Inc., Seoul (KR)

( * ) Notice: Subject to any disclaimer, the term of this patent is extended or adjusted under 35 U.S.C. 154(b) by 553 days.

(21) Appl. No.: 11/619,648

(22) Filed: Jan. 4, 2007

(65) Prior Publication Data

US 2007/0152915 A1 Jul. 5, 2007

(30) Foreign Application Priority Data

Jan. 4, 2006 (KR) ..... 10-2006-0001136

(51) Int. Cl.
*G09G 3/28* (2006.01)

(52) U.S. Cl. ..... 345/60; 345/61

(58) Field of Classification Search ..... 345/60–68; 315/169.1–169.4
See application file for complete search history.

(56) References Cited

U.S. PATENT DOCUMENTS

| | | | | |
|---|---|---|---|---|
| 2004/0056827 | A1 | 3/2004 | Hsu | |
| 2004/0125051 | A1* | 7/2004 | Hirakawa et al. | 345/63 |
| 2004/0239588 | A1 | 12/2004 | Nagao | |
| 2006/0103598 | A1* | 5/2006 | Woo et al. | 345/63 |
| 2006/0103603 | A1* | 5/2006 | Hong et al. | 345/67 |
| 2006/0158391 | A1* | 7/2006 | Sano et al. | 345/72 |
| 2007/0115219 | A1* | 5/2007 | Inoue | 345/68 |
| 2009/0015520 | A1* | 1/2009 | Akamatsu et al. | 345/67 |
| 2009/0160739 | A1* | 6/2009 | Kobayashi et al. | 345/60 |

FOREIGN PATENT DOCUMENTS

| | | |
|---|---|---|
| CN | 1612187 A | 5/2005 |
| EP | 0 903 719 A2 | 3/1999 |
| EP | 1 515 296 A2 | 3/2005 |
| JP | 2001-242824 | 9/2001 |
| JP | 2002-236468 | 8/2002 |
| KR | 102004000987 | 1/2004 |
| KR | 102005004907 | 5/2005 |

OTHER PUBLICATIONS

European Search Report dated Mar. 27, 2008 on Application No. 07250011.9-1228, 10 pages.
Chinese Office Action dated Jun. 6, 2008, for Application No. 2007100022528, 5 pages.
Korean Intellectual Property Office, Notice of Decision to Grant a Patent, Application No. 10-2006-0001136, issued Oct. 9, 2007 (3 total pages).
In-Moo Lee et al., "P-85: A New Reset Method for High Contrast Ratio and Reduction of the Reset Period of ACPDPs," SID 05 Digest, XP-001244268, pp. 614-617.

* cited by examiner

*Primary Examiner*—Nitin Patel
(74) *Attorney, Agent, or Firm*—Fish & Richardson P.C.

(57) ABSTRACT

A plasma display apparatus and a method of driving the same are disclosed. The plasma display apparatus includes a driver supplying a first signal and a second signal to a scan electrode during a reset period of at least one of a plurality of subfields of a frame. The first signal gradually rises from a first voltage to a second voltage with a first slope, and then falls from the second voltage to a third voltage with a second slope. The second signal rises from the third voltage to a fourth voltage, and then gradually rises from the fourth voltage to a fifth voltage with a third slope.

20 Claims, 13 Drawing Sheets

PLASMA DISPLAY APPARATUS AND METHOD OF DRIVING THE SAME

This Nonprovisional application claims priority under 35 U.S.C. § 119(a) on Patent Application No. 10-2006-0001136 filed in Korea on Jan. 4, 2006 the entire contents of which are hereby incorporated by reference.

BACKGROUND

1. Field

This document relates to a display apparatus, and more particularly, to a plasma display apparatus and a method of driving the same.

2. Description of the Related Art

Out of display apparatuses, a plasma display apparatus comprises a plasma display panel and a driver for driving the plasma display panel.

The plasma display panel has the structure in which barrier ribs formed between a front panel and a rear panel forms unit discharge cell or discharge cells. Each discharge cell is filled with an inert gas containing a main discharge gas such as neon (Ne), helium (He) and a mixture of Ne and He, and a small amount of xenon (Xe). The plurality of discharge cells form one pixel. For example, a red (R) discharge cell, a green (G) discharge cell, and a blue (B) discharge cell form one pixel.

When the plasma display panel is discharged by a high frequency voltage, the inert gas generates vacuum ultraviolet rays, which thereby cause phosphors formed between the barrier ribs to emit light, thus displaying an image. Since the plasma display panel can be manufactured to be thin and light, it has attracted attention as a next generation display device.

A driving voltage is supplied to the plasma display panel, thereby generating a reset discharge, an address discharge, and a sustain discharge. Accordingly, an image is displayed on the plasma display panel.

In a case where an image having the same pattern is displayed for a predetermined period of time in the related art plasma display apparatus, a state of wall charges distributed inside the discharge cell may be fixed.

For example, in a case where an image with a window pattern is displayed on the screen for a predetermined period of time, a state of wall charges distributed inside the discharge cell is maintained and fixed corresponding to the window pattern.

Accordingly, if another image other than the window pattern image is to be displayed on the screen, the window pattern image is not removed and remains on the screen, and thus image retention is generated.

SUMMARY

In one aspect, a plasma display apparatus comprises a plasma display panel including a scan electrode and a sustain electrode, and a driver supplying a first signal and a second signal to the scan electrode during a reset period of at least one of a plurality of subfields of a frame, wherein the first signal gradually rises from a first voltage to a second voltage with a first slope, and then falls from the second voltage to a third voltage with a second slope, and the second signal rises from the third voltage to a fourth voltage, and then gradually rises from the fourth voltage to a fifth voltage with a third slope.

A magnitude of the first voltage may be substantially equal to a magnitude of the third voltage.

The first voltage may be substantially equal to a ground level voltage.

The driver may supply a first sustain bias voltage to the sustain electrode during the supplying of the first signal and the second signal to the scan electrode, and the first sustain bias voltage may be lower than a second sustain bias voltage supplied to the sustain electrode during an address period.

The first sustain bias voltage may be substantially equal to a ground level voltage.

The first slope may be substantially equal to the third slope.

A magnitude of the second voltage may be substantially equal to or more than a magnitude of the fourth voltage.

A magnitude of the fifth voltage may be more than, and equal to or less than three times a magnitude of the second voltage.

The second slope may be substantially equal to a rising slope of a sustain signal supplied to the scan electrode and/or the sustain electrode during a sustain period.

A gray level of a subfield where the first signal and the second signal are supplied may be less than a gray level of another subfield where only the second signal is supplied, wherein the subfields each may be one of the plurality of subfields of the frame.

The highest voltage level of the second signal supplied in a low gray level subfield of the plurality of subfields of the frame may be more than the highest voltage level of the second signal supplied in a high gray level subfield of the plurality of subfields of the frame.

A width of the second signal in a subfield where the first signal and the second signal are supplied may be less than a width of the second signal in another subfield where only the second signal is supplied, wherein the subfields each may be one of the plurality of subfields of the frame.

A width of the second signal in a low gray level subfield among subfields where the first signal and the second signal are supplied may be more than a width of the second signal in a high gray level subfield among the subfields where the first signal and the second signal are supplied.

Before supplying the first signal, the driver may supply a falling signal with a gradually falling voltage to the scan electrode in at least one subfield where the first signal and the second signal are supplied.

The driver may supply a third sustain bias voltage to the sustain electrode during the supplying of the falling signal to the scan electrode, and the third sustain bias voltage may be higher than the second sustain bias voltage.

The third sustain bias voltage may be substantially equal to a voltage level of a sustain signal supplied to the scan electrode and/or the sustain electrode during a sustain period.

In another aspect, a method of driving a plasma display apparatus displaying an image during a frame including a plurality of subfields, the method comprises supplying a first signal to a scan electrode during a reset period of at least one of the plurality of subfields, wherein the first signal gradually rises from a first voltage to a second voltage with a first slope, and then falls from the second voltage to a third voltage with a second slope, and after supplying the first signal, supplying a second signal to the scan electrode, wherein the second signal rises from the third voltage to a fourth voltage, and then gradually rises from the fourth voltage to a fifth voltage with a third slope.

A magnitude of the first voltage may be substantially equal to a magnitude of the third voltage, a magnitude of the second voltage may be substantially equal to or more than a magnitude of the fourth voltage, and a magnitude of the fifth voltage may be more than, and equal to or less than three times a magnitude of the second voltage.

A gray level of a subfield where the first signal and the second signal are supplied may be less than a gray level of another subfield where only the second signal is supplied, wherein the subfields each may be one of the plurality of subfields of the frame.

The highest voltage level of the second signal supplied in a low gray level subfield of the plurality of subfields of the frame may be more than the highest voltage level of the second signal supplied in a high gray level subfield of the plurality of subfields of the frame.

BRIEF DESCRIPTION OF THE DRAWINGS

The accompany drawings, which are included to provide a further understanding of the invention and are incorporated on and constitute a part of this specification illustrate embodiments of the invention and together with the description serve to explain the principles of the invention.

DETAILED DESCRIPTION OF PREFERRED EMBODIMENTS

Reference will now be made in detail embodiments of the invention examples of which are illustrated in the accompanying drawings.

Figure 1:
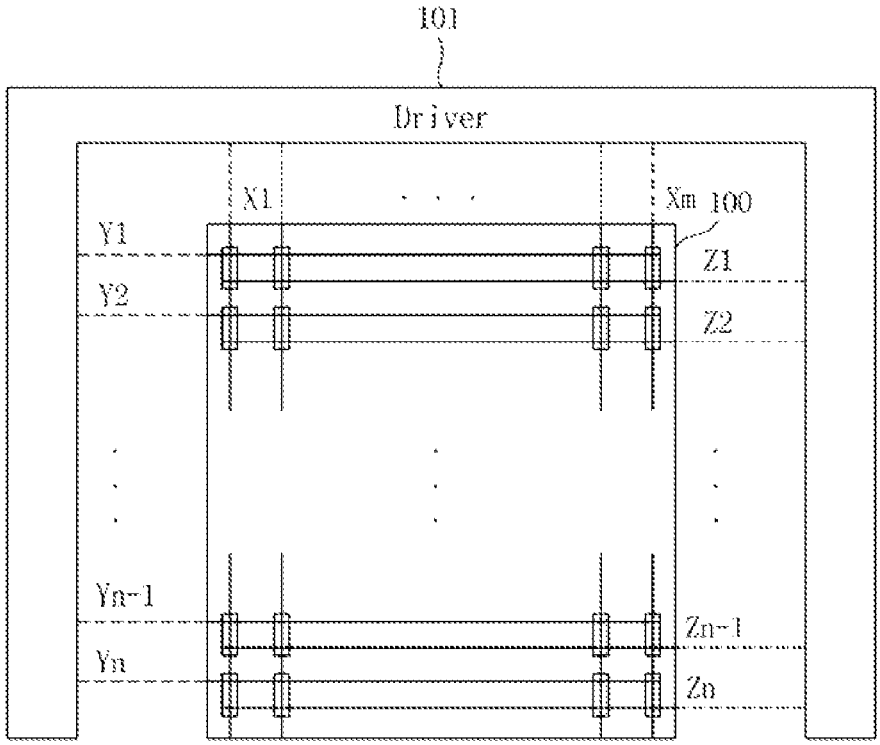
FIG. 1 illustrates a plasma display apparatus according to one embodiment.

FIG. 1 illustrates a plasma display apparatus according to one embodiment.

Referring to FIG. 1, the plasma display apparatus according to one embodiment includes a plasma display panel 100 and a driver 101.

While one driver 101 is illustrated in FIG. 1, the number of drivers may be plural depending on electrodes formed in the plasma display panel 100.

For example, in a case where the plasma display panel 100 includes address electrodes X1-Xm, scan electrodes Y1-Yn, and sustain electrodes Z1-Zn, a data driver, a scan driver, and a sustain driver may be formed.

Figure 2A:
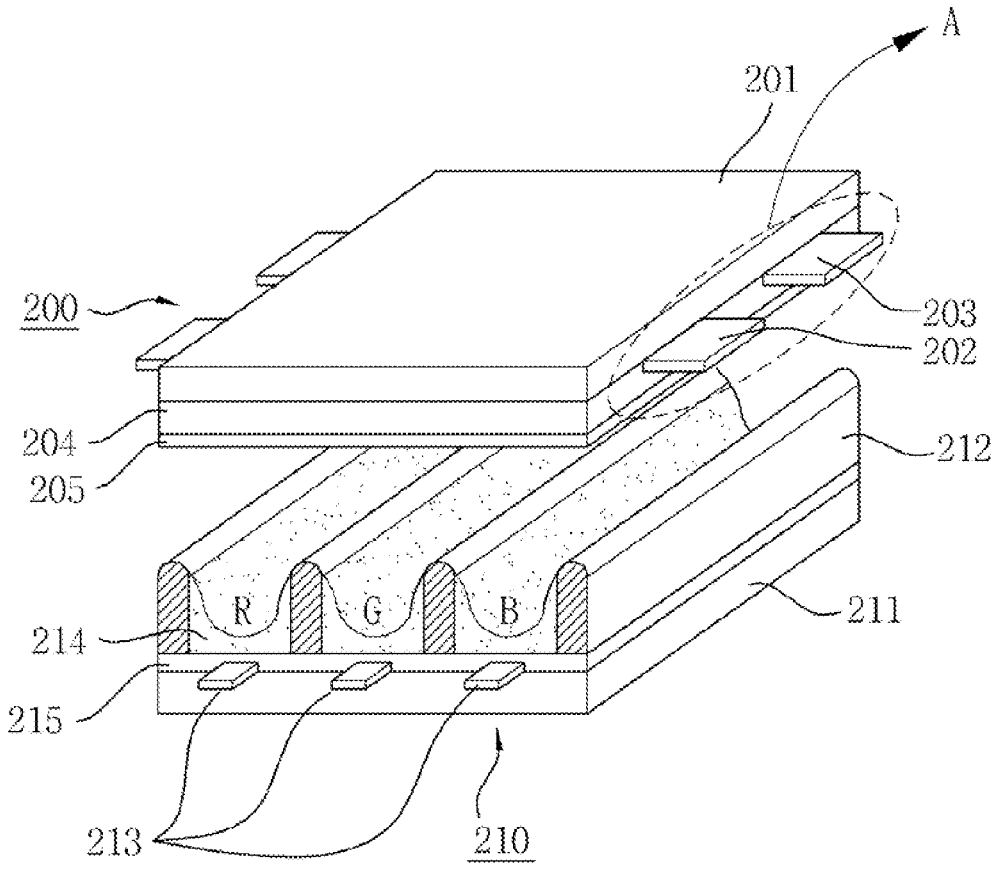
FIGS. 2*a* and 2*b* illustrate one example of a plasma display panel of the plasma display apparatus according to one embodiment.
Figure 2B:
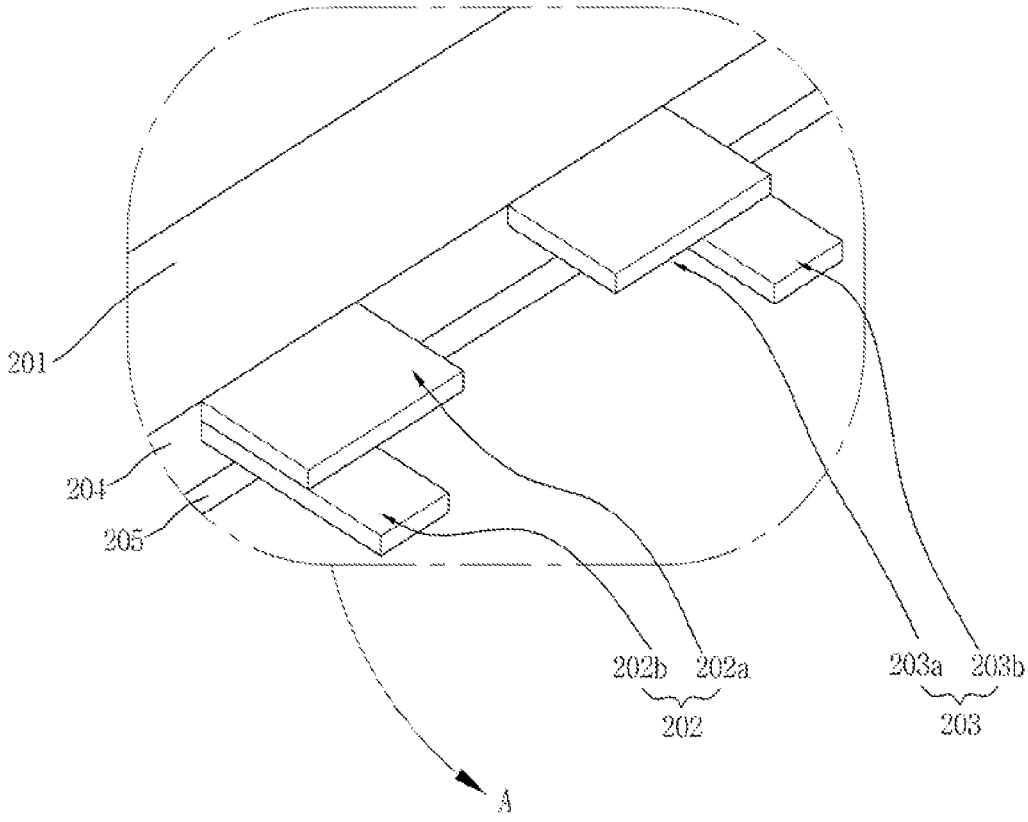

FIGS. 2*a* and 2*b* illustrate one example of a plasma display panel of the plasma display apparatus according to one embodiment.

As illustrated in FIG. 2*a*, the plasma display panel 100 of the plasma display apparatus according to one embodiment includes a front panel 200 and a rear panel 210 which are coupled in parallel to oppose to each other at a given distance therebetween. The front panel 200 includes a front substrate 201 being a display surface on which an image is displayed. The rear panel 210 includes a rear substrate 211 constituting a rear surface. A plurality of scan electrodes 202 and a plurality of sustain electrodes 203 are formed on the front substrate 201. A plurality of address electrodes 213 are arranged on the rear substrate 211 to intersect the scan electrodes 202 and the sustain electrodes 203.

The scan electrode 202 and the sustain electrode 203 generate a mutual discharge therebetween in one discharge cell, and maintain light-emissions of the discharge cells.

The scan electrode 202 and the sustain electrode 203 are covered with one or more upper dielectric layers 204 for limiting a discharge current and providing insulation between the scan electrode 202 and the sustain electrode 203. A protective layer 205 is formed on an upper surface of the upper dielectric layer 204 to facilitate discharge conditions.

The protective layer 205 is formed by depositing a material such as magnesium oxide (MgO) on the upper surface of the upper dielectric layer 204.

A plurality of stripe-type (or well-type) barrier ribs 212 are arranged in parallel on the rear substrate 211 of the rear panel 210 to form a plurality of discharge spaces (i.e., a plurality of discharge cells). The plurality of address electrodes 213 supplied with a data signal are arranged in parallel to the barrier ribs 212.

An upper surface of the rear panel 210 is coated with Red (R), green (G) and blue (B) phosphors 214 for emitting visible light for an image display when the address discharge is performed.

A lower dielectric layer 215 is formed between the address electrodes 213 and the phosphors 214 to protect the address electrodes 213.

The scan electrode 202 and the sustain electrode 203 may be formed of a conductive metal material. For example, silver (Ag) or indium-tin-oxide (ITO) may be used.

Considering light transmissivity and electrical conductivity, the scan electrode 202 and the sustain electrode 203 each may include a bus electrode made of Ag and a transparent electrode made of ITO. This will be described with reference to FIG. 2*b*.

Referring to FIG. 2*b*, the scan electrode 202 and the sustain electrode 203 for generating a surface discharge therebetween each include transparent electrodes 202*a* and 203*a* made of ITO and bus electrodes 202*b* and 203*b* made of an opaque metal material, thereby emitting light generated within the discharge cell to the outside of the plasma display panel and securing the driving efficiency.

As above, since the scan electrode 202 and the sustain electrode 203 each include the transparent electrodes 202*a* and 203*a*, visible light generated within the discharge cell is effectively emitted to the outside of the plasma display panel.

Furthermore, in a case where the scan electrode 202 and the sustain electrode 203 each include only the transparent electrodes 202*a* and 203*a*, electrical conductivity of the transparent electrodes 202*a* and 203*a* is relatively low, thereby reducing the driving efficiency. However, since the scan electrode 202 and the sustain electrode 203 further include the bus electrodes 202*b* and 203*b*, the low electrical conductivity of the transparent electrodes 202*a* and 203*a* causing a reduction in the driving efficiency is compensated.

Although FIGS. 2*a* and 2*b* have illustrated and described only one example of the plasma display panel of the plasma display apparatus according to one embodiment, the embodiment is not limited to the plasma display panel illustrated in FIGS. 2*a* and 2*b*.

For instance, although the above description illustrates a case where the upper dielectric layer 204 and the lower dielectric layer 215 each are formed in the form of a single layer, at least one of the upper dielectric layer 204 and the lower dielectric layer 215 may be formed in the form of a plurality of layers.

The plasma display panel applicable to one embodiment has only to comprise the scan electrode 202 and the sustain electrode 203. Accordingly, the plasma display panel 100 may have various structures except the above-described structural characteristic.

Referring again to FIG. 1, the driver 101 supplies a first signal and a second signal to the scan electrode Y during a reset period of at least one of a plurality of subfields of a frame. The first signal gradually rises from a first voltage V1 to a second voltage V2 with a first slope, and then falls from the second voltage V2 to a third voltage V3 with a second slope. The second signal sharply rises from the third voltage V3 to a fourth voltage V4, and then gradually rises from the fourth voltage V4 to a fifth voltage V5 with a third slope.

The driver 101 supplies a data signal having a data voltage Vd to the address electrode X.

The driver 101 supplies a scan signal of a negative polarity and a sustain signal having a sustain voltage Vs to the scan electrode Y.

The driver 101 supplies a sustain bias voltage and a sustain signal having the sustain voltage Vs to the sustain electrode Y.

Figure 3:
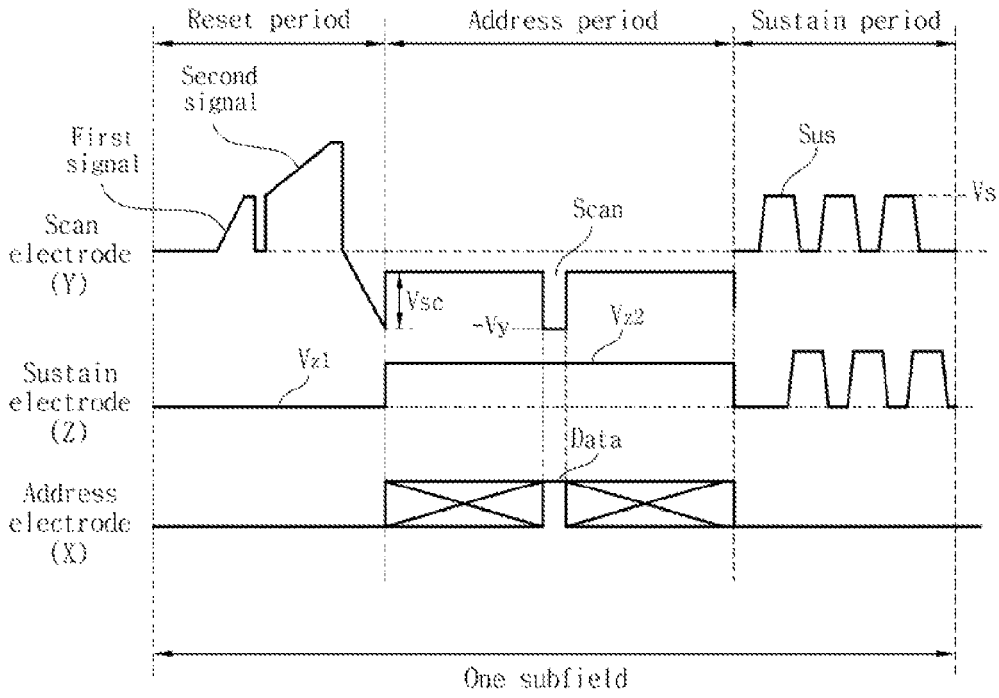
FIG. 3 illustrates one example of an operation of the plasma display apparatus according to one embodiment.

FIG. 3 illustrates one example of an operation of the plasma display apparatus according to one embodiment.

In FIG. 3, a driving waveform generated during one subfield is illustrated.

During a reset period, the first signal and the second signal are supplied to the scan electrode Y, thereby generating a weak dark discharge within the discharge cell. The weak dark discharge accumulates a proper amount of wall charges inside the discharge cell, and then a portion of wall charges is erased. The remaining wall charges are uniform inside the discharge cell to the extent that an address discharge can be stably performed. During the reset period, a state of the wall charges distributed inside the discharge cell is uniform.

By supplying the first signal and the second signal to the scan electrode Y during the reset period, the generation of image retention is prevented.

More specifically, in a case where the plasma display apparatus displays an image having the same pattern for a predetermined period of time, a state of wall charges distributed inside the discharge cell may be fixed.

For example, in a case where an image with a window pattern is displayed on the screen for a predetermined period of time, a state of wall charges distributed inside the discharge cell is maintained and fixed corresponding to the window pattern.

In this case, the first signal and the second signal are sequentially supplied. The first signal causes fluctuation in the state of the fixed wall charges inside the discharge cell. The second signal supplied subsequent to the first signal uniformizes the state of the wall charges.

Accordingly, although after images having a specific pattern are successively displayed for a predetermined period of time, another image is displayed on the screen, the generation of image retention, in which the specific pattern image is not removed and remains on the screen, is prevented.

During the supplying of the first signal and the second signal to the scan electrode Y, a first sustain bias voltage Vz1 is supplied to the sustain electrode Z. The first sustain bias voltage Vz1 is lower than a second sustain bias voltage Vz2 supplied to the sustain electrode Z during an address period. As a result, a voltage difference between the scan electrode Y and the sustain electrode Z is provided, thereby generating a reset discharge between the scan electrode Y and the sustain electrode Z.

The first sustain bias voltage Vz1 may be substantially equal to a ground level voltage GND.

During the address period, a scan reference voltage Vsc and a scan voltage −Vy of a scan signal (Scan) of a negative polarity falling from scan reference voltage Vsc are supplied to the scan electrode Y. A data voltage Vd of a data signal (Data) corresponding to the scan signal (Scan) is supplied to the address electrode X.

During the address period, the second sustain bias voltage Vz2 is supplied to the sustain electrode Z, thereby preventing the generation of an erroneous discharge caused by interference of the sustain electrode Z.

As a difference between the negative scan voltage −Vy and the data voltage Vd is added to the wall voltage generated during the reset period, the address discharge is generated within the discharge cells to which the data voltage Vd is supplied. Wall charges are formed inside the discharge cells selected by performing the address discharge such that when a sustain voltage Vs of a sustain signal (Sus) is supplied a discharge occurs.

During a sustain period, the sustain signal (Sus) is supplied to the scan electrode Y and/or the sustain electrode Z. As the wall voltage within the discharge cells selected by performing the address discharge is added to the sustain voltage Vs of the sustain signal (Sus), every time the sustain signal (Sus) is supplied, a sustain discharge, i.e., a display discharge is generated between the scan electrode Y and the sustain electrode Z. Accordingly, an image is displayed on the plasma display panel.

Figure 4:
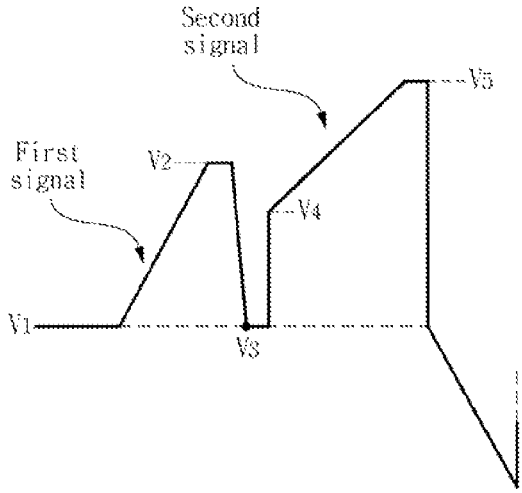
FIG. 4 illustrates a first signal and a second signal.

The following is a detailed description of the first signal and the second signal supplied to the scan electrode Y with reference to FIG. 4.

Referring to FIG. 4, the first signal gradually rises from the first voltage V1 to the second voltage V2 with the first slope, and then falls from the second voltage V2 to the third voltage V3 with the second slope.

The second signal sharply rises from the third voltage V3 to the fourth voltage V4, and then gradually rises from the fourth voltage V4 to the fifth voltage V5 with the third slope.

The second signal gradually rises to the fifth voltage V5, falls to the first voltage V1, and gradually falls with a predetermined slope.

The first slope of the first signal may be substantially equal to the third slope of the second signal. As a result, the first signal having the first slope and the second signal having the third slope are generated using the same circuit such that an increase in the manufacturing cost is prevented.

The second voltage V2 may be equal to or higher than the fourth voltage V4. As a result, the efficiency of an initialization operation obtained by the supplying of the first signal increases, and an excessive increase in an intensity of the dark discharge generated by the second signal is prevented.

The fifth voltage V5 of the second signal may be higher than and may be equal to or lower than three times the second voltage V2. As a result, a sufficient amount of wall charges remains inside the discharge cell.

Figure 5A:
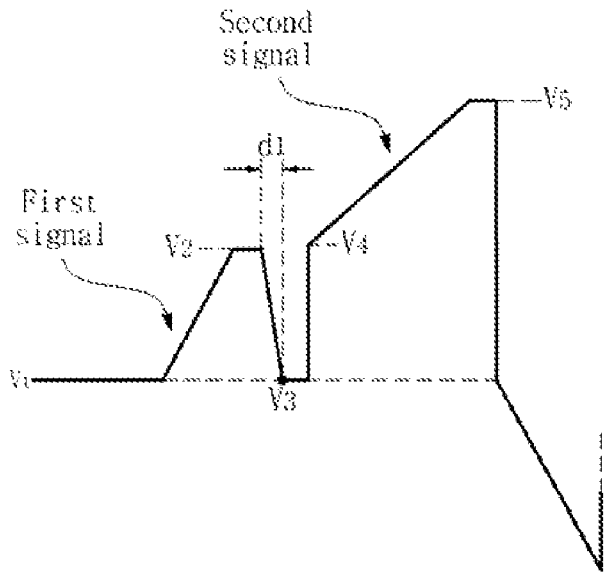
FIGS. 5*a* and 5*b* illustrate a falling slope of a first signal.
Figure 5B:
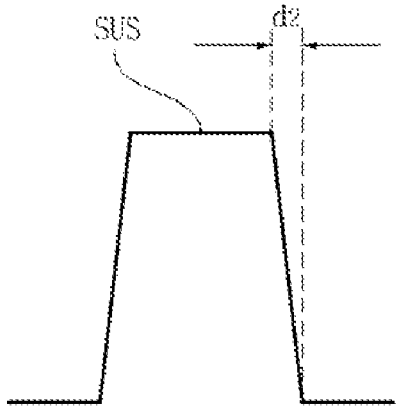

FIGS. 5*a* and 5*b* illustrates a falling slope of a first signal.

FIG. 5*a* illustrates the first signal and the second signal, and FIG. 5*b* illustrates the sustain signal supplied to the scan electrode Y and/or the sustain electrode Z during the sustain period.

Referring to FIG. 5*a*, the first signal falls with the second slope during the falling of the first signal from the second voltage V2 to the third voltage V3 (i.e., during a period d1).

The second slope may be substantially equal to a slope of the sustain signal supplied during a voltage recovery period d2 of the sustain period. As a result, the second slope and the slope of the sustain signal supplied during the voltage recovery period d2 are generated using the same circuit.

Figure 6A:
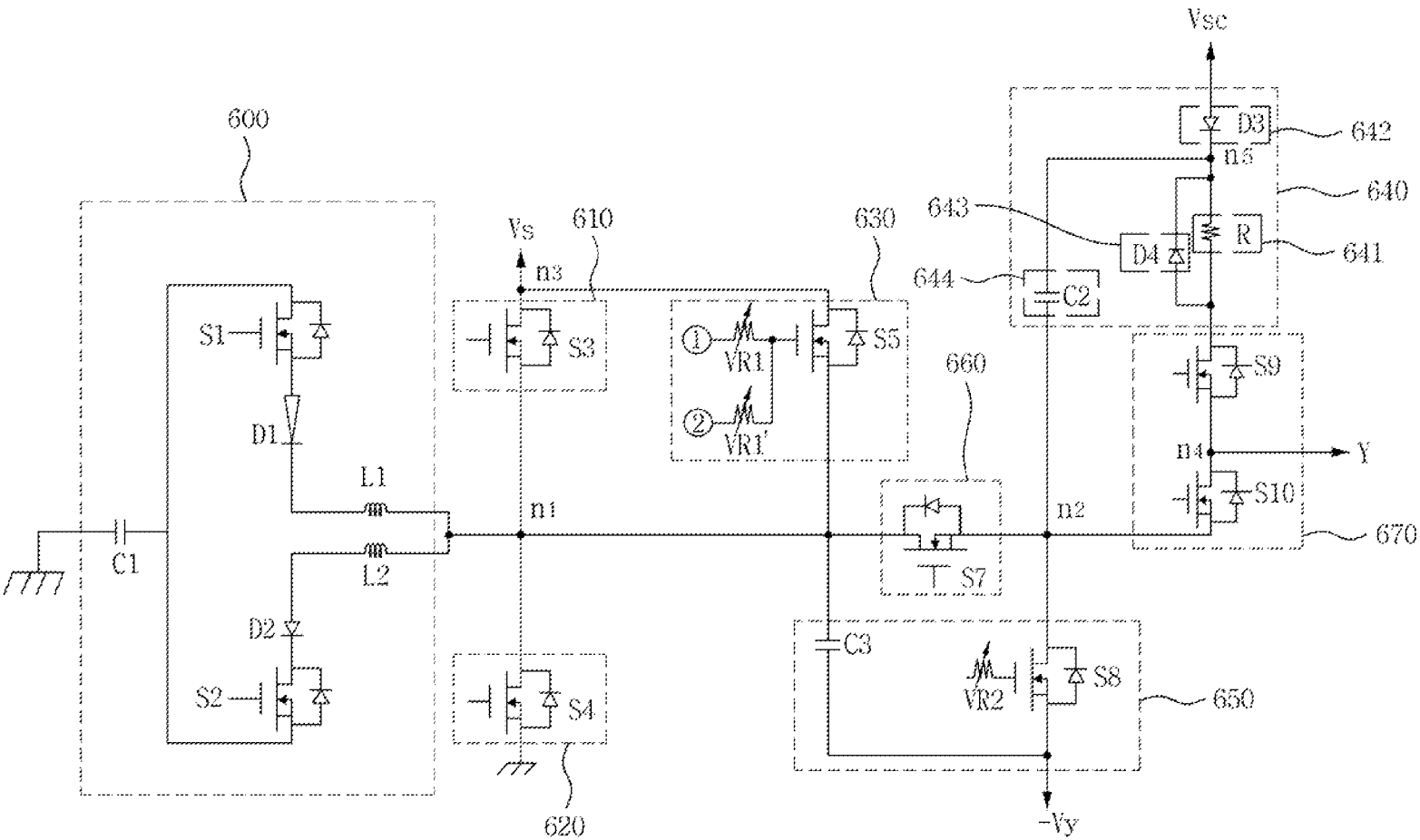
FIGS. 6*a* and 6*b* illustrate one example of a driver of the plasma display apparatus according to one embodiment.
Figure 6B:
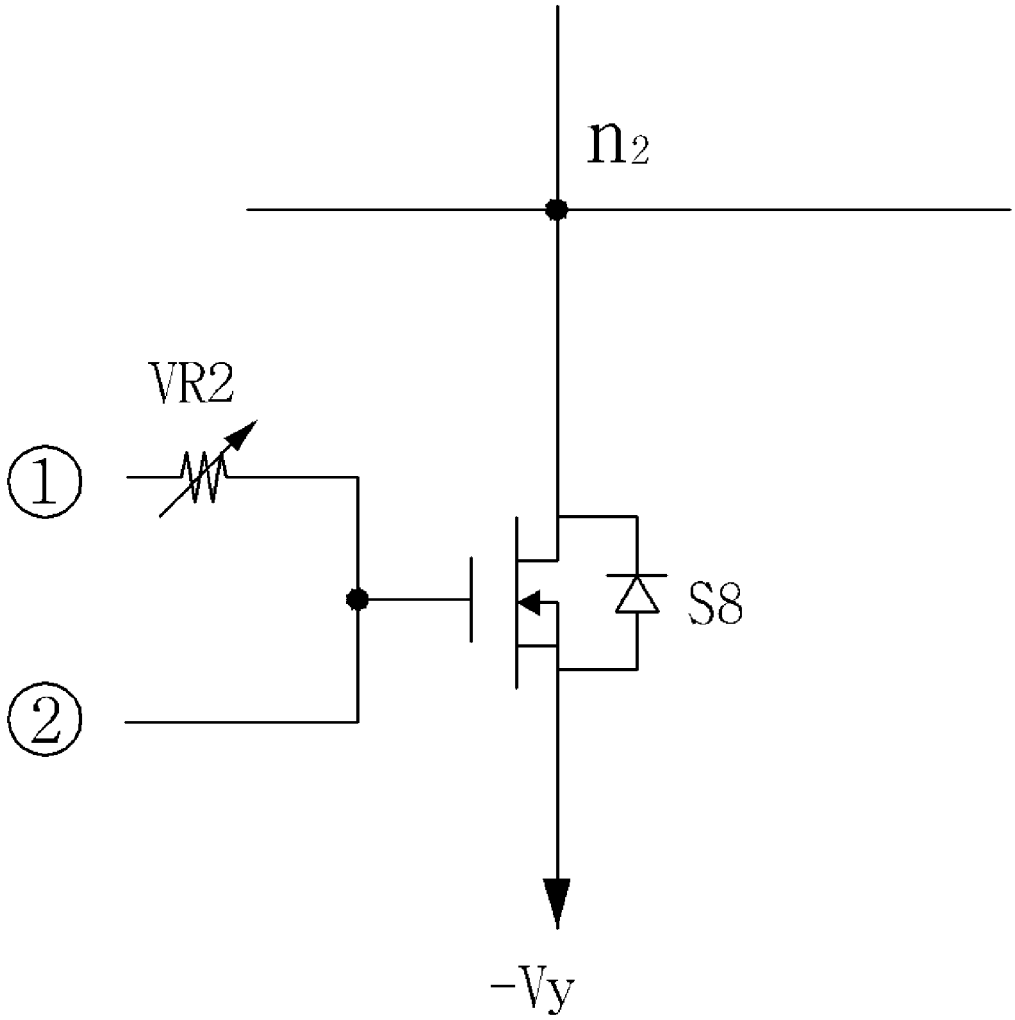

FIGS. 6*a* and 6*b* illustrate one example of a driver of the plasma display apparatus according to one embodiment.

Referring to FIG. 6*a*, the a driver of the plasma display apparatus according to one embodiment includes a scan drive integrated circuit (IC) 670, a scan reference voltage supply controller 640, a scan and falling signal common supply controller 650, and an energy recovery circuit 600.

The driver further includes a sustain voltage supply controller 610, a ground level voltage supply controller 620, and a rising signal supply controller 630.

The scan drive IC 670 includes a scan top switch S9 and a scan bottom switch S10. The scan drive IC 670 supplies a predetermined voltage supplied to the scan drive IC 670 to the scan electrode Y through switching operations of the scan top switch S9 and the scan bottom switch S10.

The scan drive IC 670 is connected to the scan electrode between the scan top switch S9 and the scan bottom switch S10.

The scan reference voltage supply controller 640 controls the supplying of the scan reference voltage Vsc to the scan drive IC 670.

The scan reference voltage supply controller 640 includes a resistor 641 and a reverse blocking unit 642.

The resistor 641 reduces a noise generated in the scan reference voltage Vsc supplied to the scan drive IC 670.

The reverse blocking unit 642 prevents an inverse current flowing from the scan drive IC 670 to a scan reference voltage source.

The resistor 641 and the reverse blocking unit 642 are in series disposed between the scan drive IC 670 and the scan reference voltage source.

The reverse blocking unit 642 includes a reverse blocking diode D3. An anode of the reverse blocking diode D3 faces toward the scan reference voltage source, and a cathode faces toward the scan drive IC 670.

The scan reference voltage supply controller 640 further includes a current path unit 643 and a fluctuation prevention unit 644.

The fluctuation prevention unit 644 includes a fluctuation prevention capacitor C2. The fluctuation prevention capacitor C2 reduces the fluctuation of the scan reference voltage Vsc supplied to the scan electrode Y.

One terminal of the fluctuation prevention capacitor C2 is commonly connected to a current path diode D4 of the current path unit 643 and the resistor 641, and the other terminal is commonly connected to the scan bottom switch S10 of the scan drive IC 670 and the scan and falling signal common supply controller 650.

The current path unit 643 includes the current path diode D4 connected in parallel to the resistor 641. The current path diode D4 passes a current flowing from the scan drive IC 670 to the fluctuation prevention unit 644.

A cathode of the current path diode D4 faces toward the fluctuation prevention capacitor C2, and an anode faces toward the scan top switch S9 of the scan drive IC 670.

Figure 7A:
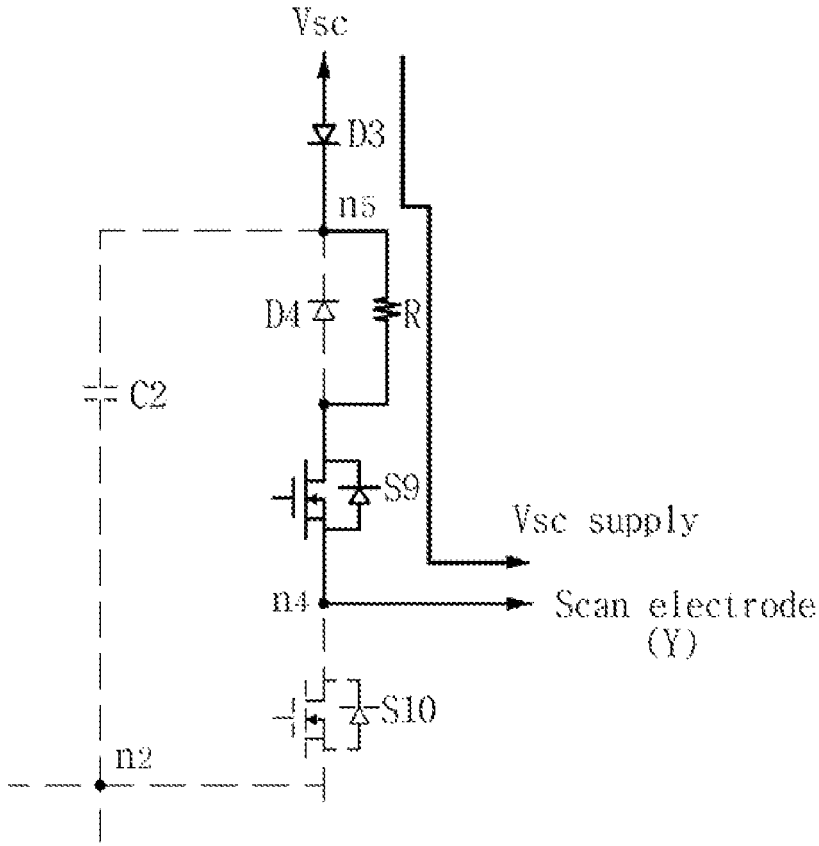
FIGS. 7*a* and 7*b* illustrate an operation of a scan reference voltage supply controller.
Figure 7B:
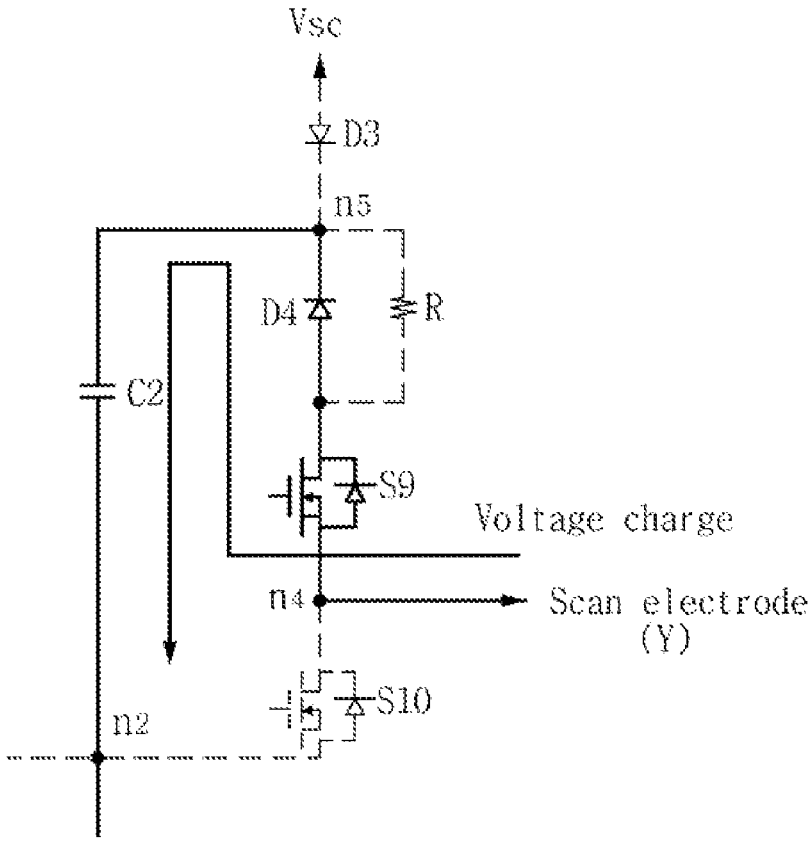

FIGS. 7*a* and 7*b* illustrate an operation of a scan reference voltage supply controller.

Referring to FIG. 7*a*, the scan reference voltage Vsc is supplied to the scan electrode Y through the scan reference voltage source, the reverse blocking diode D3, the resistor 641, and the scan top switch S9.

In this case, since the cathode of the current path diode D4 faces toward the scan reference voltage source, the scan reference voltage Vsc does not pass the current path diode D4. Therefore, the scan reference voltage Vsc, in which a noise is reduced, is supplied to the scan electrode Y.

Referring to FIG. 7*b*, a voltage of the scan electrode Y is supplied to the fluctuation prevention capacitor C2 through the scan top switch S9 and the current path diode D4 during a period ranging from a time when the supplying of the scan reference voltage Vsc to the scan electrode Y is blocked (i.e., a time when the scan top switch S9 is turned off) to a time when the scan bottom switch S10 is turned on. Accordingly, the fluctuation prevention capacitor C2 is charged to the voltage of the scan electrode Y.

Since the cathode of the reverse blocking diode D3 faces toward the scan top switch S9, the voltage output the scan electrode Y is not supplied to the scan reference voltage source.

As above, since the voltage output from the scan electrode Y is stably charged to the fluctuation prevention capacitor C2 during the period ranging from the time when the scan top switch S9 is turned off to the time when the scan bottom switch S10 is turned on, the scan driver operates stably and the energy efficiency increases.

Referring again to FIG. 6*a*, the energy recovery circuit 600 supplies a voltage previously stored in the energy recovery circuit 600 to the scan electrode Y through an energy supply path, and recovers a reactive energy from the scan electrode Y.

The energy recovery circuit 600 includes a voltage storing capacitor C1, an energy supply control switch S1, an energy recovery control switch S2, first and second inductors L1 and L2, and first and second reverse blocking diodes D1 and D2.

A voltage to be supplied to the scan electrode Y is previously stored in the voltage storing capacitor C1. When the energy supply control switch S1 is turned on, the voltage stored in the voltage storing capacitor C1 is supplied to the scan electrode Y through an energy supply path passing through the energy supply control switch S1, the first reverse blocking diode D1, and the first inductor L1.

When the energy recovery control switch S2 is turned on, a reactive energy recovered from the scan electrode Y is stored in the voltage storing capacitor C1 through an energy recovery path passing through the second inductor L2, the second reverse blocking diode D2, and the energy recovery control switch S2.

Since the different inductors L1 and L2 are disposed on the energy supply path and the energy recovery path, respectively, the amount of heat generated in the energy recovery circuit 600 decreases.

More specifically, since the voltage stored in the voltage storing capacitor C1 is supplied to the scan electrode Y through the first inductor L1 in the energy supply operation, heat is concentrically generated in the first inductor L1.

On the other hand, since the reactive energy recovered from the scan electrode Y is stored in the voltage storing capacitor C1 through the second inductor L2 in the energy recovery operation, heat is concentrically generated in the second inductor L2.

As above, the amount of heat generated in a case where the different inductors are used in the energy supply and recovery operations is less than the amount of heat generated in a case where the same inductor is used in the energy supply and recovery operations. Accordingly, a thermal damage to the energy recovery circuit 600 is prevented and the driving stability is improved.

The scan and falling signal common supply controller 650 controls the supplying of the negative scan voltage −Vy and the falling signal to the scan drive IC 670.

The scan and falling signal common supply controller 650 includes a scan and falling signal common supply control switch S8, and a second variable resistor VR2 connected to a gate terminal of the scan and falling signal common supply control switch S8.

A source terminal of the scan and falling signal common supply control switch S8 is connected to the scan bottom switch S10 of the scan drive IC 670, and a drain terminal is connected to a negative scan voltage source.

The scan and falling signal common supply controller 650 further includes a voltage stability capacitor C3.

One terminal of the voltage stability capacitor C3 is commonly connected to the scan and falling signal common supply control switch S8 and the negative scan voltage source. The other terminal of the voltage stability capacitor C3 is commonly connected to the ground level voltage supply controller 620, the sustain voltage supply controller 610, the rising signal supply controller 630, a blocking unit 660, and the energy recovery unit 600.

The voltage stability capacitor C3 stores the negative scan voltage −Vy supplied from the negative scan voltage source such that the scan and falling signal common supply controller 650 stably supplies the falling signal or the negative scan voltage −Vy to the scan electrode Y.

The scan and falling signal common supply controller 650 needs both a switching control signal for supplying the negative scan voltage −Vy and a switching control signal for supplying the falling signal.

A configuration of the scan and falling signal common supply controller 650 considering the switching control signal for supplying the negative scan voltage −Vy and the switching control signal for supplying the falling signal is illustrated in FIG. 6*b*.

Referring to FIG. 6*b*, a control signal input terminal (①) for falling signal supply and a control signal input terminal (②) for negative scan voltage supply are connected to the gate terminal of the scan and falling signal common supply control switch S8.

The second variable resistor VR2 is disposed in the control signal input terminal (①) for falling signal supply. The second variable resistor VR2 is not disposed in the control signal input terminal (②) for negative scan voltage supply.

A control signal for falling signal supply is input to the control signal input terminal (①) for falling signal supply when supplying the falling signal. Accordingly, the falling signal with a gradually falling voltage is supplied to the scan electrode Y using the second variable resistor VR2.

More specifically, when the scan and falling signal common supply control switch S8 is turned on and the control signal for falling signal supply is input to the control signal input terminal (①) for falling signal supply, a channel width of the scan and falling signal common supply control switch S8 is controlled by the second variable resistor VR2. Accordingly, the falling signal with the gradually falling voltage is generated and the falling signal is supplied to the scan electrode Y.

When supplying the negative scan voltage −Vy, a control signal for negative scan voltage supply is input to the control signal input terminal (②) for negative scan voltage supply. Accordingly, the negative scan voltage −Vy is supplied to the scan electrode Y.

The sustain voltage supply controller 610 of FIG. 6*a* includes a sustain voltage supply control switch S3. The sustain voltage supply controller 610 controls the supplying of the sustain voltage Vs to the scan electrode Y using the sustain voltage supply control switch S3.

The ground level voltage supply controller 620 includes a ground level voltage supply control switch S4. The ground level voltage supply controller 620 controls the supplying of the ground level voltage GND to the scan electrode Y using the ground level voltage supply control switch S4.

The rising signal supply controller 630 includes a rising signal supply control switch S5, and a first variable resistor VR1 connected to a gate terminal of the rising signal supply control switch S5. The rising signal supply controller 630 controls the supplying of the rising signal to the scan electrode Y using the rising signal supply control switch S5 and the first variable resistor VR1.

The blocking unit 660 is disposed between the ground level voltage supply controller 620 and the scan and falling signal common supply controller 650.

The blocking unit 660 includes a blocking switch S7. The blocking switch S7 prevents an inverse current flowing from the scan and falling signal common supply controller 650 into the ground through the ground level voltage supply controller 620.

One terminal of the sustain voltage supply controller 610 is commonly connected to a sustain voltage source and one terminal of the rising signal supply controller 630. The other terminal of the sustain voltage supply controller 610 is commonly connected to the other terminal of the rising signal supply controller 630, one terminal of the ground level voltage supply controller 620 and one terminal of the energy recovery circuit 600. The other terminal of the energy recovery circuit 600 and the other terminal of the ground level voltage supply controller 620 are grounded.

Although a case where the switches used in the driver function as a field effect transistor (FET) has been illustrated and described above, various transistor such as an insulated gate bipolar transistor (IGBT) is applicable.

Figure 8:
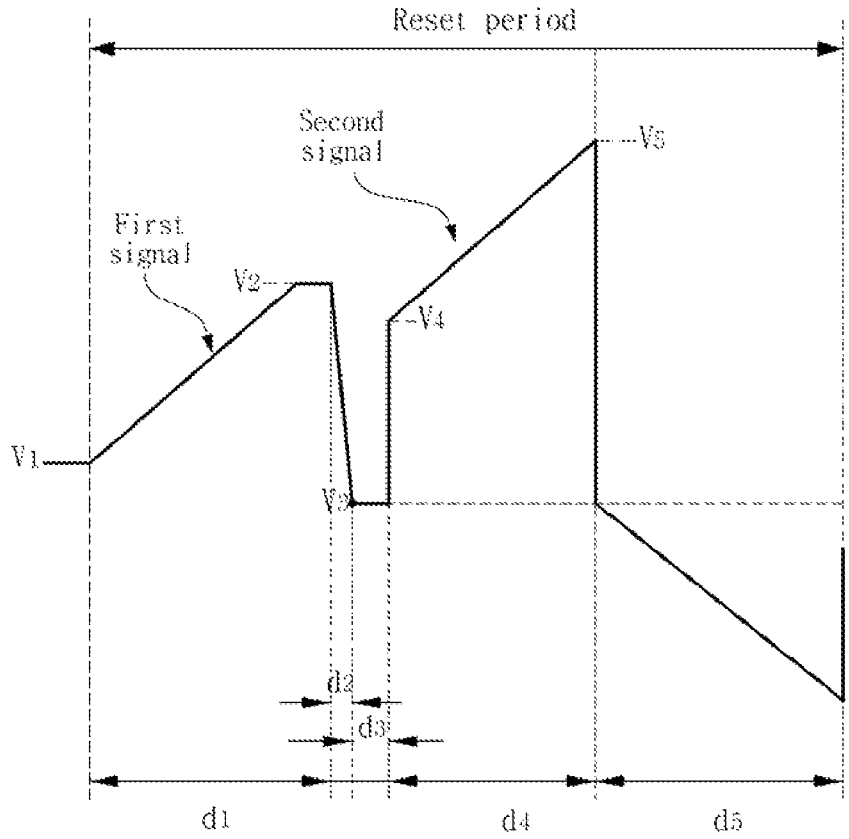
FIG. 8 illustrates one example of an operation of a driver of the plasma display apparatus according to one embodiment.

FIG. 8 illustrates one example of an operation of a driver of the plasma display apparatus according to one embodiment.

Referring to FIG. 8, the ground level voltage supply control switch S4, the blocking switch S7, and the scan bottom switch S10 are turned on such that the ground level voltage GND is supplied to the scan electrode Y. Accordingly, the voltage of the scan electrode Y is equal to the ground level voltage GND prior to a period d1.

During the period d1, when the rising signal supply control switch S5 is turned on in a turn-on state of the blocking switch S7, a channel width of the rising signal supply control switch S5 is controlled by the first variable resistor VR1. Accordingly, the rising signal with a gradually rising voltage is generated and the rising signal is supplied to the scan electrode Y. During the period d1, the voltage of the scan electrode Y gradually rises from the first voltage V1 to the second voltage V2 with the first slope.

The highest voltage during the period d1 is equal to the sustain voltage Vs, and the second voltage V2 is equal to the sustain voltage Vs.

During a period d2, the rising signal supply control switch S5 is turned off and the energy recovery control switch S2 is then turned on in turn-on states of the blocking switch S7 and the scan bottom switch S10. As a result, a reactive voltage recovered from the scan electrode Y is stored in the voltage storing capacitor C1 through the scan bottom switch S10, the blocking switch S7, the second inductor L2, the second diode D2, and the energy recovery control switch S2. During the period d2, the voltage of the scan electrode Y falls from the second voltage V2 to the third voltage V3 with the second slope.

The operation performed during the period d2 is substantially equal to the operation for supplying the sustain signal to the scan electrode and/or the sustain electrode during the sustain period. More specifically, the operation performed during the period d2 is substantially equal to the operation performed during the voltage recovery period (d2) of the sustain signal in FIG. 5*b*.

Accordingly, the second slope of the first signal is substantially equal to the slope of the sustain signal in the voltage recovery period (d2) in FIG. 5*b*.

During the periods d1 and d2, the first signal is supplied to the scan electrode Y.

During a period d3, the ground level voltage supply controller 620 is turned on such that the ground level voltage GND is supplied to the scan electrode Y.

During a period d4, the blocking switch S7, the scan bottom switch S10, the energy recovery control switch S2, and the ground level voltage supply control switch S4 are turned off. The scan top switch S9 is turned on.

The scan reference voltage Vsc is supplied to the scan electrode Y through the scan reference voltage supply controller 640. Accordingly, the voltage of the scan electrode Y sharply rises to the scan reference voltage Vsc. Therefore, the fourth voltage V4 of the second signal is equal to the scan reference voltage Vsc.

The blocking switch S7, the rising signal supply control switch S5, and the scan bottom switch S10 are turned on such that the channel width of the rising signal supply control switch S5 is controlled by the first variable resistor VR1. Accordingly, the rising signal with a gradually rising voltage is generated and the rising signal is supplied to the scan electrode Y. During the period d4, the voltage of the scan electrode Y gradually rises from the fourth voltage V4 to the fifth voltage V5 with the third slope.

The highest voltage during the period d4 is equal to a sum of the sustain voltage Vs and the scan reference voltage Vsc.

During a period d5, the scan top switch S9, the blocking switch S7, and the rising signal supply control switch S5 are turned off, and the scan bottom switch S10 and the scan and falling signal common supply control switch S8 are turned on. Accordingly, the voltage of the scan electrode Y gradually falls.

During the period d5, as illustrated in FIG. 6*b*, the control signal for falling signal supply is input to the control signal input terminal (①) for falling signal supply which is connected to the gate terminal of the scan and falling signal common supply control switch S8.

During the period d5, the voltage of the scan electrode Y may fall to the negative scan voltage −Vy.

As above, the first signal and the second signal are supplied to the scan electrode Y.

The first signal and the second signal may be supplied to the scan electrode Y during reset periods of all subfields of a frame. Alternatively, the first signal and the second signal may be supplied to the scan electrode Y during a reset period of a predetermined subfield of a plurality of subfields of a frame.

Figure 9A:
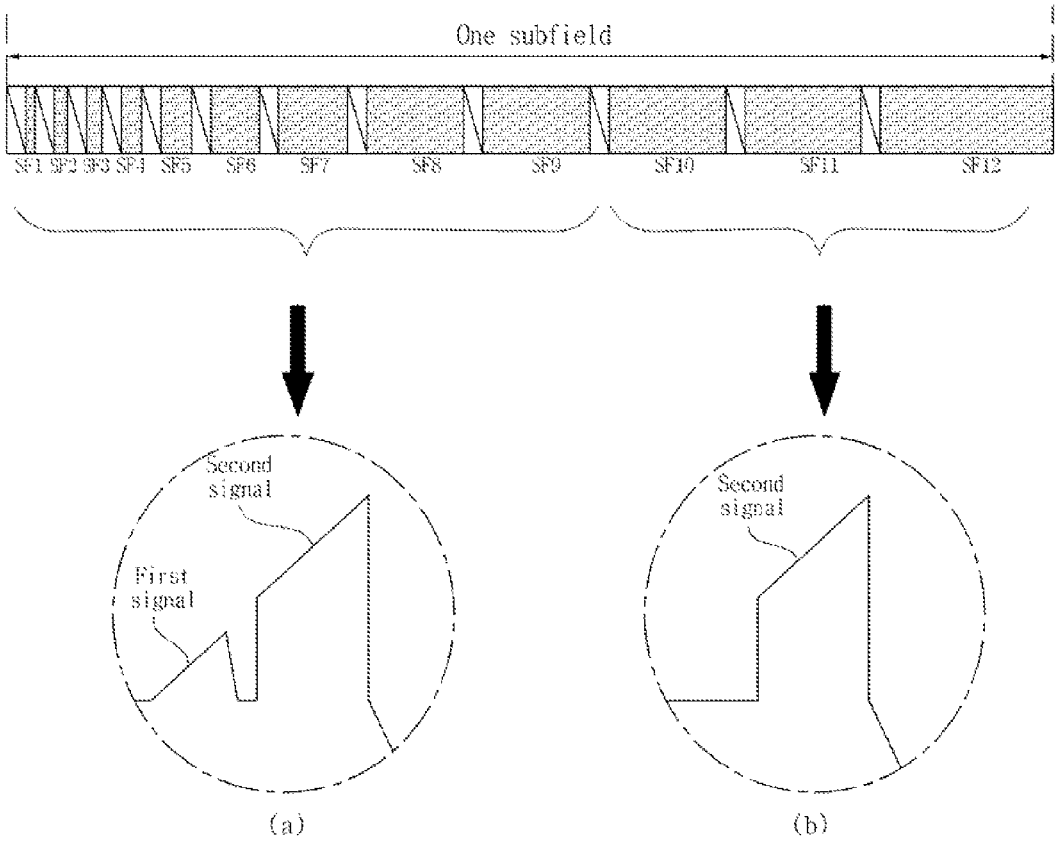
FIGS. 9*a* and 9*b* illustrate one example of a method of using a first signal and a second signal during a predetermined subfield of a plurality of subfields of a frame.
Figure 9B:
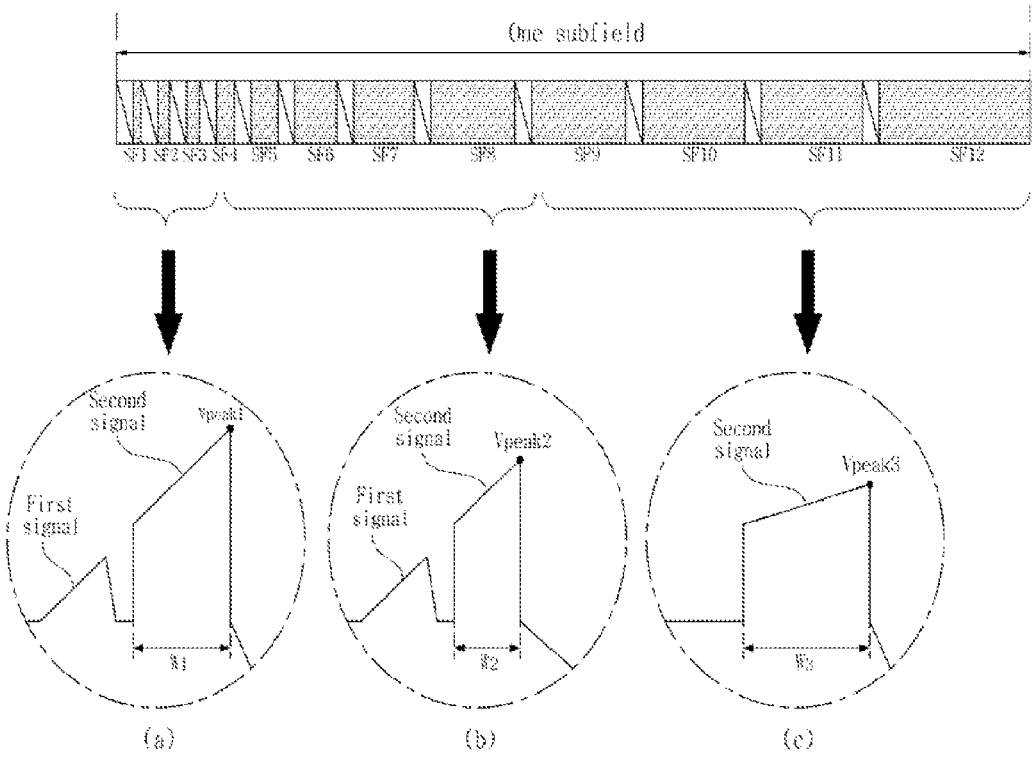

FIGS. 9*a* and 9*b* illustrate one example of a method of using a first signal and a second signal during a predetermined subfield of a plurality of subfields of a frame.

Referring to FIG. 9*a*, in a case where one frame includes a total of 12 subfields, the first signal and the second signal are supplied to the scan electrode Y during reset periods of first to ninth subfields SF1-SF9. The second signal is supplied to the scan electrode Y during reset periods of tenth to twelfth subfields SF10-SF12. The second signal supplied during the tenth to twelfth subfields SF10-SF12 is substantially equal to the second signal supplied during the first to ninth subfields SF1-SF9.

The 12 subfields SF1-SF12 are arranged in increasing order of gray level weight.

Since the number of sustain signals supplied during sustain periods of the low gray weight subfields is less than the number of sustain signals supplied during sustain periods of the high gray weight subfields, an unstable discharge may occur in the low gray weight subfields. Therefore, the first signal and the second signal are supplied in the low gray weight subfields.

Referring to FIG. 9*b*, in a case where one frame includes a total of 12 subfields, the first signal and the second signal are supplied to the scan electrode Y during reset periods of first to eighth subfields SF1-SF8. The second signal is supplied to the scan electrode Y during reset periods of ninth to twelfth subfields SF9-SF12.

The highest voltage level of the second signal is the largest in the low gray level subfields, and is the smallest in the high gray level subfields.

More specifically, the highest voltage level Vpeak1 of the second signal supplied during the reset periods of the first to third subfields SF1-SF3 is more than the highest voltage level Vpeak2 of the second signal supplied during the reset periods of the fourth to eighth subfields SF4-SF8. Further, the highest voltage level Vpeak2 is more than the highest voltage level Vpeak3 of the second signal supplied during the reset periods of the ninth to twelfth subfields SF9-SF12.

Although FIG. 9*b* has illustrated and described a case where the highest voltages Vpeak1 of the second signals supplied during the reset periods of the first to third subfields SF1-SF3 are equal to one another, the present embodiment is not limited thereto.

For example the highest voltage level of the second signal supplied during the reset period of the first subfield SF1 may be set to be more than the highest voltage level of the second signal supplied during the reset period of the second subfield SF2.

As above, as the gray level weight increases, the highest voltage level of the second signal is reduced. Accordingly, contrast is improved.

Widths W1 and W2 of the second signal supplied to the scan electrode Y during the reset periods of the first to eighth subfields SF1-SF8 may be set to be less than a width W3 of the second signal supplied to the scan electrode Y during the reset periods of the ninth to twelfth subfields SF9-SF12.

In other words, a width of the second signal in a subfield where one reset signal (i.e., the second signal) is supplied may be set to be more than a width of the second signal in a subfield where two reset signals (i.e., the first and second signals) are supplied Since one reset signal is supplied in the high gray level subfields, a duration of the reset period is secured such that a sufficient amount of wall charges are accumulated.

Further, the width W1 of the second signal in the relatively low gray level subfields SF1-SF3 among the subfields SF1-SF9 where two reset signals are supplied may set to be more than the width W2 of the second signal in the relatively high gray level subfields SF4-SF9.

For example, the width W1 of the second signal supplied during the reset periods of the first to third subfields may be set to more than the width W2 of the second signal supplied during the reset periods of the fourth to eighth subfields.

Accordingly, contrast is improved and a margin of the reset period is secured.

Although FIG. 9*b* has illustrated and described a case where the widths W1 of the second signals supplied during the reset periods of the first to third subfields SF1-SF3 are equal to one another, the present embodiment is not limited thereto.

For example, a width of the second signal supplied during the reset period of the first subfield SF1 may be set to be more than a width of the second signal supplied during the reset period of the second subfield SF2.

As above, as the gray level weight increases, the width of the second signal is reduced.

Before supplying the first signal, a falling signal with a gradually falling voltage is supplied to the scan electrode during at least one subfield where the first signal and the second signal are supplied to the scan electrode Y.

Figure 10:
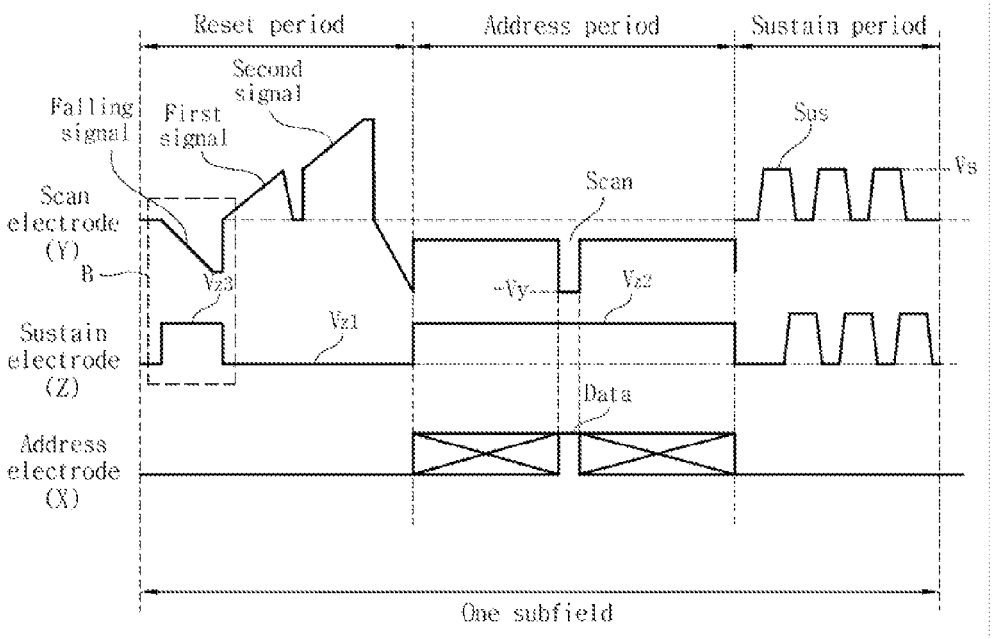
FIG. 10 illustrates one example of a method for supplying a falling signal prior to the supplying of a first signal to a scan electrode during at least one subfield where the first signal and a second signal are supplied to the scan electrode.

The following is a detailed description of the falling signal with reference to FIG. 10.

As illustrated in an area B of FIG. 10, before supplying the first signal, a falling signal with a gradually falling voltage is supplied to the scan electrode during at least one subfield where the first signal and the second signal are supplied to the scan electrode Y.

During the supplying of the falling signal, a third sustain bias voltage Vz3 is supplied to the sustain electrode Z. The third sustain bias voltage Vz3 is higher than the second sustain bias voltage Vz2 supplied to the sustain electrode Z during the address period.

Accordingly, wall charges of a positive polarity are accumulated on the scan electrode Y inside the discharge cell, and wall charges of a negative polarity are accumulated on the sustain electrode Z.

The first signal and the second signal are supplied to the scan electrode Y in the above state of the wall charges distributed inside the discharge cell, thereby easily generating the reset discharge. Accordingly, an initialization operation by the reset discharge is performed more efficiently.

Further, although the voltages of the first signal and the second signal are reduced in the above state of the wall charges distributed inside the discharge cell, a reset discharge occurs and an initialization operation by the reset discharge is performed.

The third sustain bias voltage Vz3 may be substantially equal to the sustain voltage Vs supplied during the sustain period.

As above, although an image having the same pattern is displayed on the screen for a predetermined period of time in the plasma display apparatus according to one embodiment, the generation of image retention is prevented.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures. Moreover, unless the term "means" is explicitly recited in a limitation of the claims, such limitation is not intended to be interpreted under 35 USC 112(6).

What is claimed is:

1. A plasma display apparatus comprising:

a plasma display panel including a scan electrode and a sustain electrode; and a driver supplying a first signal and a second signal to the scan electrode during a reset period of at least one of a plurality of subfields of a frame, wherein the first signal gradually rises from a first voltage to a second voltage with a first slope, and then falls from the second voltage to a third voltage with a second slope, and the second signal rises from the third voltage to a fourth voltage, and then gradually rises from the fourth voltage to a fifth voltage with a third slope.

2. The plasma display apparatus of claim 1, wherein a magnitude of the first voltage is substantially equal to a magnitude of the third voltage.

3. The plasma display apparatus of claim 2, wherein the first voltage is substantially equal to a ground level voltage.

4. The plasma display apparatus of claim 1, wherein the driver supplies a first sustain bias voltage to the sustain electrode during the supplying of the first signal and the second signal to the scan electrode, and the first sustain bias voltage is lower than a second sustain bias voltage supplied to the sustain electrode during an address period.

5. The plasma display apparatus of claim 4, wherein the first sustain bias voltage is substantially equal to a ground level voltage.

6. The plasma display apparatus of claim 1, wherein the first slope is substantially equal to the third slope.

7. The plasma display apparatus of claim 1, wherein a magnitude of the second voltage is substantially equal to or more than a magnitude of the fourth voltage.

8. The plasma display apparatus of claim 1, wherein a magnitude of the fifth voltage is more than, and is equal to or less than three times a magnitude of the second voltage.

9. The plasma display apparatus of claim 1, wherein the second slope is substantially equal to a rising slope of a sustain signal supplied to the scan electrode and/or the sustain electrode during a sustain period.

10. The plasma display apparatus of claim 1, wherein a gray level of a subfield where the first signal and the second signal are supplied is less than a gray level of another subfield where only the second signal is supplied, wherein the subfields each are one of the plurality of subfields of the frame.

11. The plasma display apparatus of claim 1, wherein the highest voltage level of the second signal supplied in a low gray level subfield of the plurality of subfields of the frame is more than the highest voltage level of the second signal supplied in a high gray level subfield of the plurality of subfields of the frame.

12. The plasma display apparatus of claim 1, wherein a width of the second signal in a subfield where the first signal and the second signal are supplied is less than a width of the second signal in another subfield where only the second signal is supplied, wherein the subfields each are one of the plurality of subfields of the frame.

13. The plasma display apparatus of claim 1, wherein a width of the second signal in a low gray level subfield among subfields where the first signal and the second signal are supplied is more than a width of the second signal in a high gray level subfield among the subfields where the first signal and the second signal are supplied.

14. The plasma display apparatus of claim 4, wherein before supplying the first signal, the driver supplies a falling signal with a gradually falling voltage to the scan electrode in at least one subfield where the first signal and the second signal are supplied.

15. The plasma display apparatus of claim 14, wherein the driver supplies a third sustain bias voltage to the sustain electrode during the supplying of the falling signal to the scan electrode, and the third sustain bias voltage is higher than the second sustain bias voltage.

16. The plasma display apparatus of claim 15, wherein the third sustain bias voltage is substantially equal to a voltage level of a sustain signal supplied to the scan electrode and/or the sustain electrode during a sustain period.

17. A method of driving a plasma display apparatus displaying an image during a frame including a plurality of subfields, the method comprising:

supplying a first signal to a scan electrode during a reset period of at least one of the plurality of subfields, wherein the first signal gradually rises from a first voltage to a second voltage with a first slope, and then falls from the second voltage to a third voltage with a second slope; and after supplying the first signal, supplying a second signal to the scan electrode, wherein the second signal rises from the third voltage to a fourth voltage, and then gradually rises from the fourth voltage to a fifth voltage with a third slope.

18. The method of claim 17, wherein a magnitude of the first voltage is substantially equal to a magnitude of the third voltage, a magnitude of the second voltage is substantially equal to or more than a magnitude of the fourth voltage, and a magnitude of the fifth voltage is more than, and is equal to or less than three times a magnitude of the second voltage.

19. The method of claim 17, wherein a gray level of a subfield where the first signal and the second signal are supplied is less than a gray level of another subfield where only the second signal is supplied, wherein the subfields each are one of the plurality of subfields of the frame.

20. The method of claim 17, wherein the highest voltage level of the second signal supplied in a low gray level subfield of the plurality of subfields of the frame is more than the highest voltage level of the second signal supplied in a high gray level subfield of the plurality of subfields of the frame.

* * * * *